United States Patent [19]

Funk

[11] 4,125,384

[45] Nov. 14, 1978

[54] METHOD AND APPARATUS FOR CONTINUOUSLY FEEDING SOLID PARTICLES INTO A PRESSURIZED CONTAINER

[75] Inventor: Erwin D. Funk, Glens Falls, N.Y.

[73] Assignee: Kamyr Inc., Glens Falls, N.Y.

[21] Appl. No.: 774,043

[22] Filed: Mar. 3, 1977

[51] Int. Cl.[2] ..... C10J 3/30

[52] U.S. Cl. ..... 48/86 R; 48/197 R; 48/210; 48/DIG. 7; 110/101 R; 110/238; 214/17 B; 214/17 C; 222/194; 302/14; 302/66

[58] Field of Search ..... 48/86 R, 86 A, 73, 76, 48/77, 87, 89, 99, 101, 197 R, 202, 203, 206, 210, DIG. 4, DIG. 7; 222/194; 214/17 C, 17 B; 302/11, 14, 15, 16, 66; 209/234, 243, 268; 210/247, 400; 110/7 S, 31, 101 R; 162/237, 246

[56] References Cited

U.S. PATENT DOCUMENTS

| | | | |
|---|---|---|---|
| 2,595,312 | 5/1952 | Talboys | 214/17 R |
| 3,429,773 | 2/1969 | Richter | 162/237 |
| 3,849,247 | 11/1974 | Richter | 162/237 |
| 3,950,146 | 4/1976 | Funk | 48/197 R |
| 3,950,147 | 4/1976 | Funk et al. | 48/197 R |
| 4,017,270 | 4/1977 | Funk et al. | 48/197 R |
| 4,039,425 | 8/1977 | Neavel | 48/201 |

*Primary Examiner*—S. Leon Bashore
*Assistant Examiner*—George C. Yeung
*Attorney, Agent, or Firm*—Cushman, Darby & Cushman

[57] ABSTRACT

A method of continuously feeding solid particles into a pressurized container which comprises the steps of confining a body of liquid having a specific gravity less than the specific gravity of the particles in proximity to the pressurized container, maintaining communication of the pressure conditions within the pressurized container with a free surface of the confined body of liquid so as to maintain the body of liquid under pressure, continuously introducing a supply of solid particles entrained in liquid under pressure into the body of liquid under pressure, causing the entrained particles introduced into the body of liquid to continuously move toward the bottom portion thereof, mechanically continuously moving the particles in the bottom portion of the body of liquid upwardly along a confined path which extends from a position adjacent the bottom portion of the body of liquid upwardly above the level of the aforesaid free surface thereof to a feed position in pressure communication with the interior of the pressurized container from which the particles can be fed into the pressurized container, allowing the entraining liquid filling the spaces between the solid particles being moved upwardly to drain from the particles downwardly into the body of liquid, continuously withdrawing liquid from the body of liquid at a level at or near the free surface thereof in an amount so related to the amount of particles and entrained liquid introduced thereto and particles removed thereby along the path sufficient to maintain the free surface at a substantially constant level and along a liquid withdrawal flow path arrangement devoid of restrictions of a size less than that necessary to permit free passage thereby of any fine particles entrained in the withdrawn liquid and apparatus for practicing the method.

37 Claims, 5 Drawing Figures

METHOD AND APPARATUS FOR CONTINUOUSLY FEEDING SOLID PARTICLES INTO A PRESSURIZED CONTAINER

This invention relates to coal gasification and more particularly to improvements in a continuous system for feeding lump coal under pressure to a fixed bed type gasifier.

The type of coal gasification process and apparatus to which the present invention is applicable is disclosed in commonly assigned co-pending application Ser. No. 542,407 filed Jan. 20, 1975, which issued Apr. 12, 1977 as U.S. Pat. No. 4,017,270 (see also, commonly assigned U.S. Pat. No. 3,950,146). The invention also has applicability to feed systems of the type disclosed in commonly assigned U.S. Pat. No. 3,950,147, as well as other solid particle feed systems for other types of pressurized containers.

The method and apparatus for continuously feeding lump coal under pressure to the gasifying vessel as disclosed in the above-identified application embodies a transfer device for transferring successive incremental volumes of coal particles entrained in a liquid from a first low pressure flow path into a circuitous high pressure flow path. The high pressure flow path includes a separator device for containing a volume or body of liquid in the high pressure flow path which has a free surface in communication with the pressure conditions within the gasifier vessel. In this way, the high pressure flow path is maintained at a high energy level in comparison with the energy level of the first flow path by virtue of this pressure intercommunication. The movement of liquid and particles along the high pressure flow path is accomplished by a pump which is positioned upstream from the position at which the successive incremental volumes of particles and entrained liquid are transferred by the transfer device into the high pressure flow path. The separator device also includes a mechanism for moving the solid particles in the volume or liquid body contained therein upwardly through the free surface thereof and into the gasifier vessel. In the aforesaid application the separator device embodies screens which are disposed in screening relation to the particles so as to prevent movement of the solid particles into the high pressure liquid return line of the system. Where such screens are provided there is always presented the possibility of clogging.

An object of the present invention is the provision of an apparatus and method for effecting the separation and feeding of solid particles of the type described into a pressurized container of the type described which does not provide screening means susceptible to blockage or clogging. In accordance with the principles of the present invention, this objective is obtained by providing a pressure vessel for containing a body of liquid having a free surface in communication with the pressure conditions of the gasifier vessel. The liquid utilized, preferably water, has a specific gravity less than the specific gravity of the solid particles such as coal, which are to be separated and fed to the gasifier vessel under pressure. The feed of the supply of solid particles entrained in liquid into the body of the liquid contained within the pressure vessel is through a tangential conduit as to cause the solid particles to be evenly distributed to the lower portion of the body of liquid. Mounted within the vessel is a helical blade rotor which serves to move the solid particles upwardly from the bottom portion of the liquid body along a confined path above the free surface into a feed position from which the particles can enter the gasifier vessel through a feed pipe. The liquid withdrawal arrangement is communicated with the liquid body at or near the free surface where there are virtually no particles other than fines entrained in the liquid. It therefore becomes readily possible to arrange for uniform withdrawal without the necessity of providing any restrictions to flow of a size less than that which will allow free passage of the fines. In this way, the separation and feeding of the solid particles of the larger lump size range is accomplished without those particles or those of smaller size ever coming into screening relation to a screening surface which could become clogged.

A further object of the present invention is the provision of an apparatus of the type described which is simple in construction, effective in operation and economical to manufacture and maintain.

These and other objects of the present invention will become more apparent during the course of the following detailed description of the invention and the appended claims.

The invention may best be understood with reference to the accompanying drawings wherein an illustrative embodiment is shown.

Figure 1:
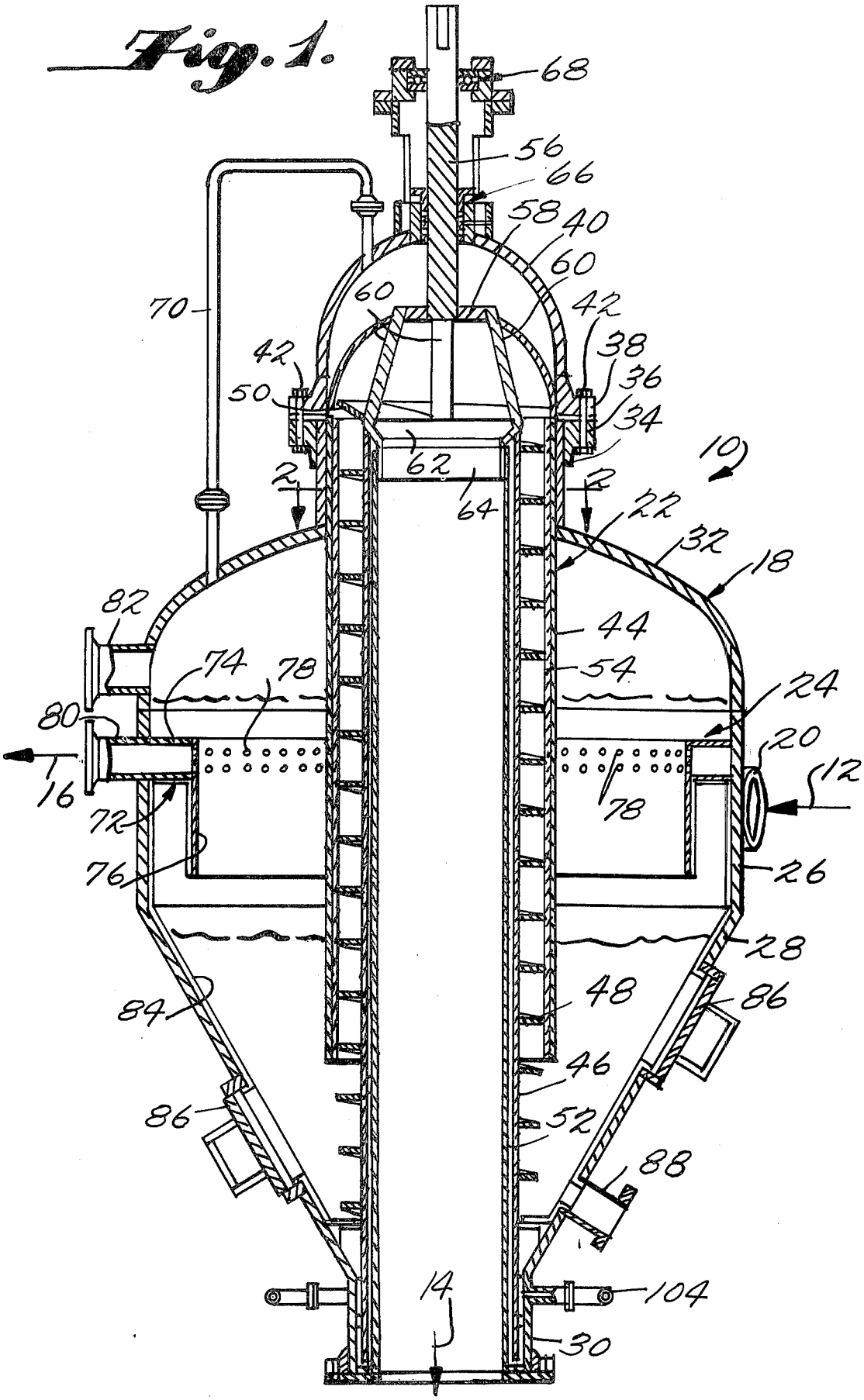
FIG. 1 is a vertical sectional view of an apparatus embodying the principles of the present invention.

Referring now more particularly to FIG. 1 of the drawings, there is shown therein an apparatus, generally indicated at 10, which embodies the principles of the present invention. The apparatus is particularly suited to be utilized in a feed system of the type disclosed in co-pending commonly assigned U.S. application Ser. No. 542,407 filed Jan. 20, 1975, the disclosure of which is hereby incorporated by reference into the present application for purposes of background.

For present purposes, it is sufficient to note that the apparatus 10 is adapted to receive a continuous supply of solid particles such as coal within a size range of from approximately ¼ inch nominal diameter to approximately 2 inches nominal diameter entrained in liquid. The liquid is preferably water, although other liquids may be utilized if desired so long as the liquid has a specific gravity less than the specific gravity of the particles.

The slurry supply is fed to the apparatus 10 under pressure continuously as indicated by the arrow 12. The apparatus is adapted to feed solid particles having the main body of entraining liquid separated therefrom to a gasifier vessel continuously as indicated by the arrow 14. In order to maintain the input and output of the apparatus 10 substantially equal so that it can be operated continuously, a flow of separated liquid continuously is withdrawn from the apparatus as indicated by the arrow 16.

The apparatus 10 comprises a pressure vessel, generally indicated at 18, which is adapted to contain a body of liquid therein having a free surface disposed in communicating relation with the pressure conditions within the gasifier vessel which is fed by the apparatus 10 or other pressurized container (not shown). The particle and entraining liquid supply 12 is introduced into the body of liquid contained within the vessel 18 via tangential feed conduit 20. The particles thus continuously introduced into the body of liquid are evenly distributed into the body of liquid and tend to move downwardly toward the lower portion of the body of liquid. The apparatus 10 includes a mechanical particle lifting mechanism, generally indicated at 22, which serves to move the particles in the lower portion of the body of liquid upwardly through a confined path above the free surface of the body of liquid to a feed position from which the particles can be moved into the pressure container as indicated by the arrow 14. As the particles are moved upwardly above the free surface, the entrained liquid therein is allowed to drain downwardly into the body of liquid so that as the particles reach the feed position and are moved into the pressurized container, as indicated by the arrow 14, substantially the only liquid retained with the particles is that amount which is retained by surface adherence. Finally, the apparatus 10 includes a system, generally indicated at 24, for withdrawing liquid from the body of liquid at a level at or near the free surface thereof in an amount so related to the amount of particles and entrained liquid introduced thereto and particles removed thereby along the aforesaid path as to be sufficient to maintain the free surface at a substantially constant level and along a liquid withdrawal flow path arrangement which is devoid of restrictions of a size less than that necessary to permit free passage thereby of any fine particles entrained in the withdrawn liquid.

The pressure vessel 18 may be of any suitable construction and, as shown, consists of a peripheral wall arcuate about a generally vertically extending axis formed by a multiplicity of metallic annular sections welded together. The vessel includes an upper cylindrical section 26 which carries the tangential inlet conduit 20, the conduit communicating tangentially to the interior of the cylindrical section 26. Extending below the cylindrical section 26 is a frustoconical lower section 28, the section diverging downwardly at an inclination of approximately 60° and having its lower end fixed to a lower cylindrical section 30. Fixed to the upper edge of the upper cylindrical section 26 is a dome section 32 provided with a central aperture which is connected with the lower end of an upper cylindrical section 34. The upper end of the upper cylindrical section 34 is formed with a radially outwardly extending attaching flange 36 which cooperates with the lower peripheral flange 38 of a top dome section 40. It will be understood that the top dome section 40 is detachably sealingly connected to the remaining structure of the vessel 18, as by a plurality of bolts 42 extending between the flanges 36 and 38.

The lifting mechanism 22 preferably includes a cylindrical housing section 44 which is fixed at its upper end within the upper cylindrical section 34 of the vessel 18. The cylindrical housing section 44 extends downwardly into the interior of the vessel 18 with its axis generally concentric with the axis of the vessel, the lower edge terminating in spaced relation to the lower central section 30. The cylindrical housing section 44 defines the confined path along which the particles move from the lower portion of the body of liquid within the vessel 18 upwardly through the free surface thereof and into the feed position which is defined by the open upper end of the cylindrical housing section 44.

Rotatably mounted within the housing section 44 for rotation about an axis concentric with the axis of the housing section 44 is a helical blade rotor assembly which includes a hollow cylindrical hub member 46 and a helical blade 48 extending outwardly from the periphery thereof. As shown, the helical blade extends generally radially outwardly in cross-section from the periphery of the hollow cylindrical hub member 46 and has its upper flight bent upwardly so as to extend radially outwardly and upwardly from the exterior periphery as indicated at 50. This disposition of the upper flight of the helical blade 48 serves to direct the particles moved upwardly by the helical blade radially inwardly into the upper end of a fixed standpipe or feed tube 52.

Figure 2:
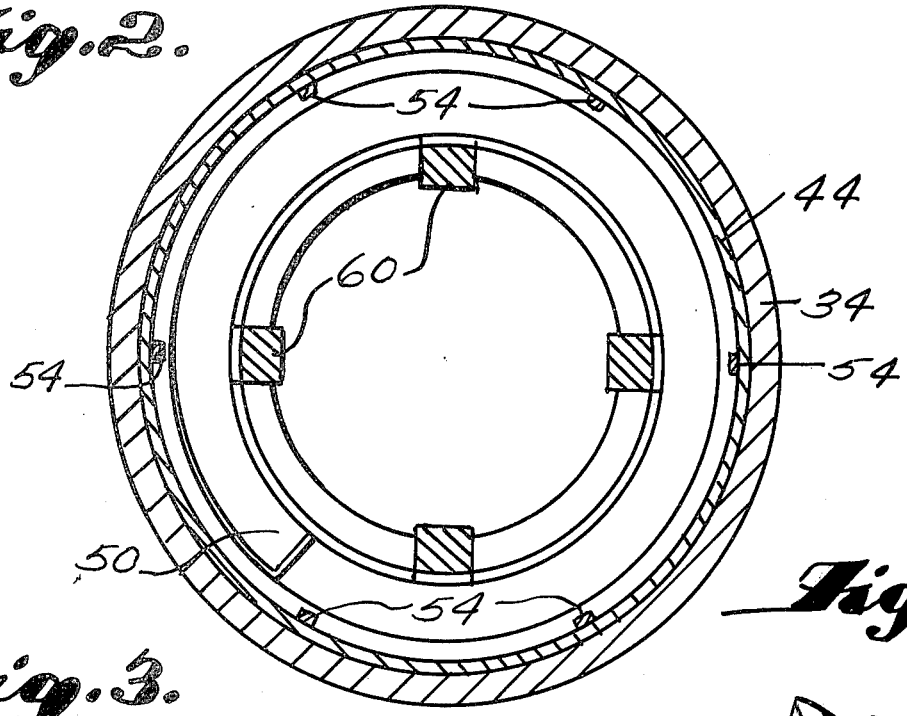
FIG. 2 is an enlarged fragmentary sectional view taken along the line 2—2 of FIG. 1.

In order to assist the movement of particles upwardly in response to the rotation of the helical blade 48, there is mounted on the inner periphery of the cylindrical housing section 44 a plurality of longitudinally extending anti-rotation bars 54. These bars, six of which are provided as best shown in FIG. 2, serve to prevent the particles engaged by the helical blade 48 from rotating with the helical blade and in this way act to materially assist the upward movement of the particles.

Figure 4:
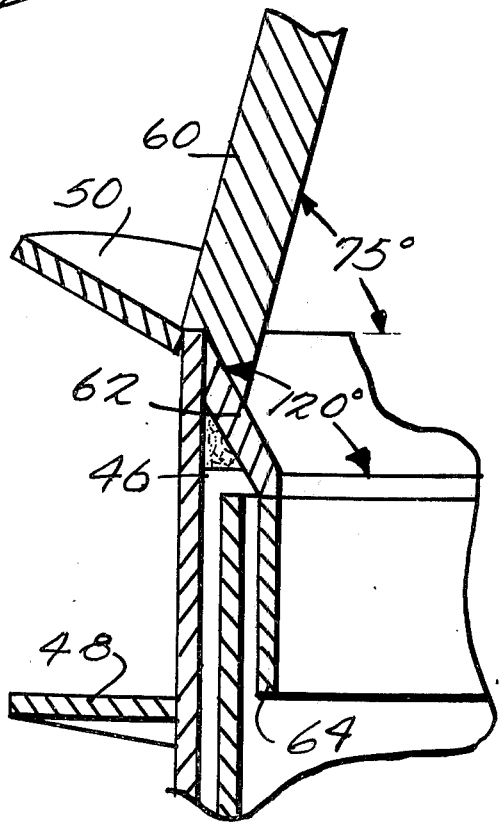
FIG. 4 is an enlarged fragmentary sectional view of another detailed portion as shown in FIG. 1.

The rotor assembly is rotated by an exteriorly mounted motor or the like (not shown) having its output shaft (not shown) connected to the upper end of a shaft 56 which extends through a central opening in the top dome section 40 and has a disc member 58 fixed to the lower end thereof. The disc member 58 has a plurality of connecting elements 60 fixed in annularly spaced relation to the periphery thereof, which elements extend downwardly and outwardly and are welded to the upper end of the cylindrical hub member 46, as is clearly shown in FIG. 4. The connection of the elements 60 with the hub member 46 includes an inner downwardly extending frustoconical element 62 having a cylindrical lip 64 formed on the lower end thereof which serves to prevent the passage of particles upwardly over the upper edge of the feed tube 52 which might tend to become lodged between the exterior surface thereof and the interior surface of the hollow hub member 46.

It will be noted that a suitable packing assembly 66 is mounted in the central portion of the top dome section 40 for sealingly engaging the periphery of the shaft 56 and that the upper end of the shaft 56 is provided with a bearing assembly, as indicated at 68.

Moreover, since the interior of the top dome section 40 is communicated directly with the pressure conditions within the interior of the gasifier vessel or other pressurized container through feed tube 52, these conditions can be communicated to the upper surface of the body of liquid within the vessel 18, as by a connecting pipe assembly 70, extending upwardly from the dome section 40 and then through the dome section 32.

The liquid withdrawal system 24, as shown, preferably includes a manifold structure 72 which is mounted in cooperating relation around the interior of the upper cylindrical vessel section 26 at a position above the tangential inlet conduit 20. The manifold 72 is formed by a pair of longitudinally spaced ring-shaped walls 74 fixed to the interior of the cylindrical section 26 and an inner cylindrical wall 76 interconnecting the inner edges of the ring-shaped walls 74 and extending downwardly therebelow in coextensive relation with the inlet conduit 20. Formed in the cylindrical wall 76 at or near the free surface of the body of liquid within the container 18 and at a level between the ring-shaped plates 74 is a multiplicity of openings 78. These openings serve to communicate the upper portion of the liquid body with the manifold 72 so that there will be an even distribution of liquid into the manifold at a sufficiently low velocity through each of the holes such that there is very little tendency for the flow to cause entrainment of large particles. From the manifold arrangement 72 there is provided an exit pipe 80 through which the return liquid as indicated by the flow arrow 16. It will be understood that the arrangement providing a multiplicity of openings 78 as described above is preferred since this arrangement enables the free surface to be maintained slightly above the openings. In order to prevent the free surface from rising above a predetermined level in the vessel 18 there is provided an overflow pipe 82. It will be understood that while the arrangement as shown enables the independent monitoring (not shown) of the free surface thereabove, the arrangement for withdrawing the liquid could be by means of a simple overflow weir principle in which the cylindrical wall 76 is made imperforate and is extended upwardly to a position just below the level of the free surface. Under these circumstances the upper ring-shaped wall 74 is skeletonized or provided with relatively large openings so that the flow of liquid is over the upper edge of the wall 76 and into the manifold arrangement 72 and out of the pipe 80 so that a separate overflow pipe 82 would not be needed. This arrangement falls clearly within the contemplation of the present invention and is not considered preferable because it does not provide for any control of the liquid free surface level when the same is disposed below the upper edge of the cylindrical wall 76.

With the arrangement provided it is preferable to provide the interior of the wall surfaces of the sections 26 and 28, the lower surface of the lower ring-shaped wall 74 and the outer surface of the portion of the cylindrical wall 76 extending therebelow with a lining 84 of abrasion resistant and corrosive resistant material. It will also be understood that the vessel 18 may include one or more suitably covered inspection manholes as indicated at 86. In addition, formed in the wall section 28 as shown in FIG. 1, is a flush-out port 88. It will be understood that the port 88 may be provided with a suitable valve (not shown) for controlling a flush-out circuit also not shown.

Figure 3:
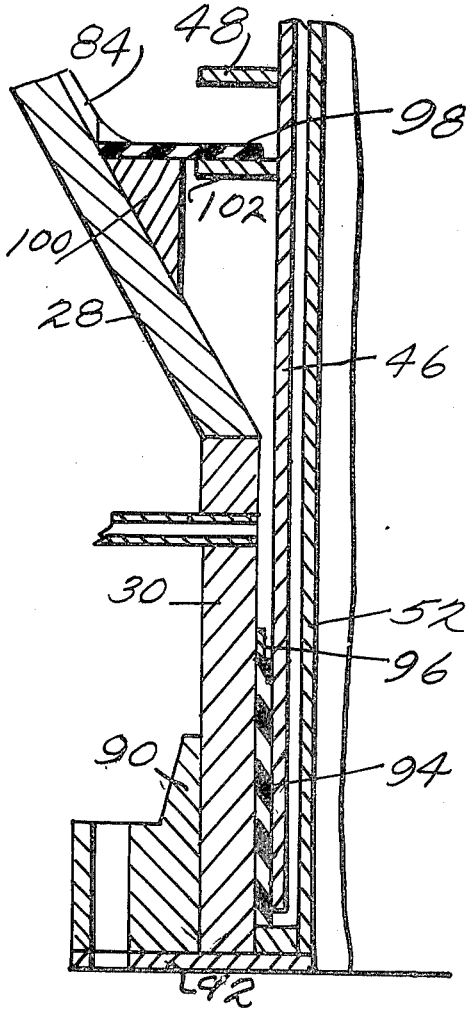
FIG. 3 is an enlarged fragmentary sectional view of a detailed portion shown in FIG. 1.

The manner in which the lower end of the rotatable hub member 46 is journalled and sealed within the lower end of the wall section 30 and feed pipe 52 is best shown in detail in FIG. 3. First, it will be noted that the lower outer periphery of the wall section 30 is formed with a flange 90, the lower surface of the flange 90 and the adjacent end edges of the wall section 30 and feed tube 52 being rigidly interconnected by a disk member 92. A sleeve bearing member 94 is disposed between the inner periphery of the wall section 30 and the lower exterior periphery of the hub member 46. The sleeve bearing may be made of any suitable bearing material, a preferred material is a glass fiber filled plastic material, such as polytetrafluoroethylene. The bearing is retained in position by an upper retaining ring 96.

In order to prevent small solid particles within the vessel 18 from contacting the bearing 94 there is provided an annular seal in the form of a radially extending annular flap 98 fixed to a suitable ring 100 welded to the inner surface of the vessel wall section 28 adjacent the lower end thereof. A ring disk 102 is fixed to the exterior periphery of the hub member 46 in a longitudinal position to engage beneath the free marginal end surface of the flap 98.

Finally, a clear purge water manifold, generally indicated at 104, is provided in the wall section 30 between the bearing and flap 98, for the purpose of purging the bearing and flap seal of any small particles.

Figures 5, 6:
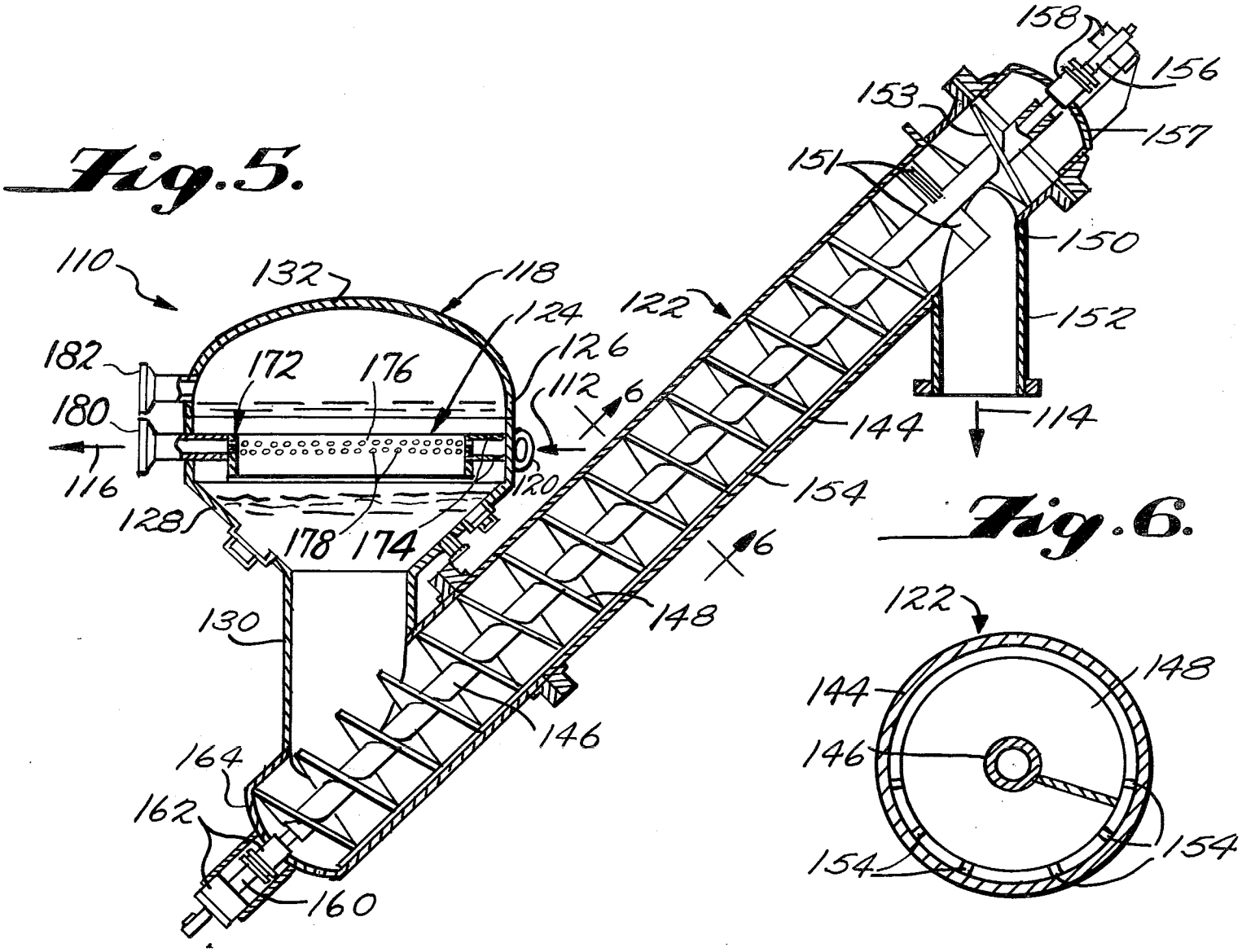
FIG. 5 is a view similar to FIG. 1 illustrating an apparatus of modified form embodying the principles of the present invention.
FIG. 6 is an enlarged fragmentary sectional view taken along the line 6—6 of FIG. 5.

The arrangement described above including the vertically spaced hub member 46 with its helical blade 48 constitutes a preferred embodiment of the present invention since the particles are moved upwardly in a manner which minimizes the wear on the housing section 44. The arrangement also is desirable in that its vertical extent can be relatively short. An alternative arrangement is shown in FIGS. 5 and 6 in the form of a modified apparatus 110.

The apparatus 110 comprises a pressure vessel, generally indicated at 118, which is similar to the vessel 18 previously described and is adapted to contain a body of liquid therein having a free surface disposed in communicating relation with the pressure conditions within the gasifier vessel which is fed by the apparatus 110 or other pressurized container (not shown). The particle and entraining liquid supply 112 is introduced into the body of liquid contained within the vessel 118 via tangential feed conduit 120. The particles thus continuously introduced into the body of liquid are evenly distributed into the body of liquid and tend to move downwardly toward the lower portion of the body of liquid. The apparatus 110 includes a mechanical particle lifting mechanism, generally indicated at 122, which serves to move the particles in the lower portion of the body of liquid upwardly through a confined path above the free surface of the body of liquid to a feed position from which the particles can be moved into the pressure container as indicated by the arrow 114. As the particles are moved upwardly above the free surface, the entrained liquid therein is allowed to drain downwardly into the body of liquid so that as the particles reach the feed position and are moved into the pressurized container, as indicated by the arrow 114, substantially the only liquid retained with the particles is that amount which is retained by surface adherence. Finally, the apparatus 110 includes a system, generally indicated at 124, for withdrawing liquid from the body of liquid at a level at or near the free surface thereof in an amount so related to the amount of particles and entrained liquid introduced thereto and particles removed thereby along the aforesaid path as to be sufficient to maintain the free surface at a substantially constant level and along a liquid withdrawal flow path arrangement which is devoid of restrictions of a size less than that necessary to permit free passage thereby of any fine particles entrained in the withdrawn liquid.

The pressure vessel 118 may be of any suitable construction and, as shown, consists of a peripheral wall arcuate about a generally vertically extending axis formed by a multiplicity of metallic annular sections welded together. The vessel includes an upper cylindrical section 126 which carries the tangential inlet conduit 120, the conduit communicating tangentially to the interior of the cylindrical section 126. Extending below the cylindrical section 126 is a frustoconical lower section 128, the section diverging downwardly at an inclination of approximately 60° and having its lower end fixed to a lower cylindrical section 130. Fixed to the upper edge of the upper cylindrical section 126 is a dome section 132.

The lifting mechanism 122 preferably includes a cylindrical housing section 144 which is fixed at its lower end with the lower end of lower cylindrical section 130 of the vessel 118. The cylindrical housing section 144 extends upwardly at an angle to the exterior of the vessel 118 with its axis disposed generally at an angle of 45° with respect to the axis of the vessel 118. The cylindrical housing section 144 defines the confined path along which the particles move from the lower portion of the body of liquid within the vessel 118 upwardly through the free surface thereof and into the feed position which is defined at an opening 150 in the upper end of the cylindrical housing section 144.

Rotatably mounted within the housing section 144 for rotation about an axis concentric with the axis of the housing section 144 is a helical blade rotor assembly which includes a central shaft member 146 and a helical blade 148 extending outwardly from the periphery thereof. As shown, the helical blade 148 extends generally radially outwardly in cross-section from the periphery of the shaft member 146. The helical blade 148 extends upwardly within the housing section 144 beyond the liquid level up to the vertical level of the opening 150. A pair of blades or paddles 151 extends outwardly from the shaft at the opening 150. A feed pipe 152 extends downwardly from the opening. In addition, a short reversing helical blade section 153 is formed on the shaft above the paddles 151.

In order to assist the movement of particles upwardly in response to the rotation of the helical blade 148, there is mounted on the lower inner periphery of the cylindrical housing section 144 a plurality of longitudinally extending anti-rotation bars 154. These bars, six of which are provided as best shown in FIG. 6, serve to prevent the particles engaged by the helical blade 148 from rotating with the helical blade and in this way act to materially assist the upward movement of the particles.

The rotor assembly is rotated by an exteriorly mounted motor or the like (not shown) having its output shaft (not shown) connected to the upper end of an upper shaft section 156 which extends through a central opening in a top dome section 157 on the upper end of the annular housing section 144 and is fixed to the upper end of shaft member 146. It will be understood that a suitable sealed bearing assembly 158 is provided between the shaft section 156 and top dome section 157. In a like manner, the lower end of the shaft member 146 is fixedly connected with a shaft section 160 having a sealed bearing assembly 162 mounted thereon and carried by a lower dome section 164 fixed to the lower end of the annular housing section 144.

The liquid withdrawal system 124 is similar to the system 24 previously described and includes a manifold structure 172 which is mounted in cooperating relation around the interior of the upper cylindrical vessel section 126 at a position above the tangential inlet conduit 120. The manifold 172 is formed by a pair of longitudinally spaced ring-shaped walls 174 fixed to the interior of the cylindrical section 126 and an inner cylindrical wall 176 interconnecting the inner edges of the ring-shaped walls 174 and extending downwardly therebelow in coextensive relation with the inlet conduit 120. Formed in the cylindrical wall 176 at or near the free surface of the body of liquid within the container 118 and at a level between the ring-shaped plates 174 is a multiplicity of openings 178. These openings serve to communicate the upper portion of the liquid body with the manifold 172 so that there will be an even distribution of liquid into the manifold at a sufficiently low velocity through each of the holes such that there is very little tendency for the flow to cause entrainment of large particles. From the manifold arrangement 172 there is provided an exit pipe 180 through which the return liquid as indicated by the flow arrow 116. As before, in order to prevent the free surface from rising above a predetermined level in the vessel 18 there is provided an overflow pipe 182.

The inclined helical blade rotor embodiment shown in FIG. 5 is desirable because of its mechanical simplicity as compared with the hollow helical blade rotor of the apparatus 10. However, the longitudinal extent of the inclined rotor must be greater than the longitudinal extent of the concentric vertical rotor and the housing section 144 which is subject to wear must contain pressure, whereas the housing section 44 does not.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A method of continuously feeding solid carbonaceous particles into a pressurized container which comprises the steps of:

confining a body of liquid inert with respect to the particles and having a specific gravity less than the specific gravity of said particles in proximity to the pressurized container, maintaining communication of the pressure conditions within said pressurized container with a free surface of the confined body of liquid so as to maintain said body of liquid under pressure, continuously introducing a supply of solid particles entrained in liquid under pressure into the body of liquid under pressure, causing the entrained particles introduced into said body of liquid to continuously move toward the bottom portion thereof, mechanically continuously moving the particles in the bottom portion of said body of liquid upwardly along a non-foraminous confined path which extends from a position adjacent the bottom portion of the body of liquid upwardly above the level of the aforesaid free surface thereof to a feed position in pressure communication with the interior of the pressurized container from which the particles can be fed into the pressurized container, allowing the entraining liquid filling the spaces between the solid particles being moved upwardly to drain from the particles downwardly into the body of liquid during the aforesaid movement of the particles above the free surface of the body of liquid so that substantially the only liquid retained with said particles as they pass from said feed position and into said pressurized container is that amount which is retained by surface adherence, and continuously withdrawing liquid from said body of liquid at a level at or near the free surface thereof in an amount so related to the amount of particles and entrained liquid introduced thereto and particles removed thereby along said path sufficient to maintain said free surface at a substantially constant level and along a liquid withdrawal flow path arrangement devoid of restrictions of a size less than that necessary to permit free passage thereby of any fine particles entrained in the withdrawn liquid.

2. A method as defined in claim 1 wherein said solid particles are of gas producing material and said pressurized container is a gasification vessel.

3. A method as defined in claim 2 wherein said gas producing material is coal.

4. A method as defined in claim 3 wherein the coal particles are within a size range of from approximately ¼ inch nominal diameter to approximately 2 inches nominal diameter.

5. A method as defined in claim 4 wherein the liquid is water.

6. A method as defined in claim 1 wherein the liquid is water.

7. Apparatus for continuously feeding solid particles into a pressurized container comprising:

a vessel for confining a body of liquid having a specific gravity less than the specific gravity of said particles in proximity to the pressurized container, means for maintaining communication of the pressure conditions within said pressurized container with a free surface of the confined body of liquid so as to maintain said body of liquid under pressure, means for continuously introducing a supply of solid particles entrained in liquid under pressure into the body of liquid under pressure so that the entrained particles will move continuously toward the bottom portion of said body of liquid, mechanical means for continuously moving the particles in the bottom portion of said body of liquid upwardly along a non-foraminous confined path which extends from a position adjacent the bottom portion of the body of liquid upwardly above the level of the aforesaid free surface thereof to a feed position in pressure communication with the interior of the pressurized container from which the particles can be fed into the pressurized container so that the entraining liquid filling the spaces between the solid particles being moved upwardly will drain from the particles downwardly into the body of liquid during the aforesaid movement of the particles above the free surface of the body of liquid whereby substantially the only liquid retained with said particles as they pass from said feed position and into said pressurized container is that amount which is retained by surface adherance, and means for continuously withdrawing liquid from said body of liquid at a level at or near the free surface thereof in an amount so related to the amount of particles and entrained liquid introduced thereto and particles removed thereby along said path sufficient to maintain said free surface at a substantially constant level and along a liquid withdrawal flow path arrangement devoid of restrictions of a size less than that necessary to permit free passage thereby of any fine particles entrained in the withdrawn liquid.

8. Apparatus as defined in claim 7 wherein said vessel includes a peripheral wall which is arcuate about a generally upright axis and said supply introducing means comprises a conduit extending generally tangentially to the interior of said peripheral wall.

9. Apparatus as defined in claim 8 wherein said peripheral wall includes a frustoconical lower section and a cylindrical section thereabove which carries said tangential conduit.

10. Apparatus as defined in claim 9 wherein said mechanical means comprises an annular housing section defining said confined path mounted within said peripheral wall in generally concentric relation with the axis thereof, and helical blade rotor means mounted within said housing section for rotational movement about a rotational axis generally concentric to the axis of said housing section.

11. Apparatus as defined in claim 10 wherein said housing section is cylindrical and has a series of circumferentially spaced anti-rotation bars extending longitudinally along the interior periphery thereof.

12. Apparatus as defined in claim 11 wherein the helical blade rotor means is hollow and a feed tube is mounted therewithin in fixed relation to the peripheral wall of said vessel, the upper end of said feed tube being disposed to receive the solid particles issuing from the upper end of said helical blade rotor means, the lower end of said feed tube extending exteriorly of said vessel to said pressurized container.

13. Apparatus as defined in claim 12 wherein said liquid withdrawal means includes an annular manifold within said peripheral wall at a position above said tangential conduit, the inner periphery of said annular manifold being formed by a cylindrical wall which extends downwardly below said manifold in vertical coextensive relation to said tangential conduit.

14. Apparatus as defined in claim 13 wherein said cylindrical wall includes a series of circumferentially spaced openings extending into said annular manifold.

15. Apparatus as defined in claim 14 including a liquid overflow conduit means in the peripheral wall of said vessel above said annular manifold.

16. Apparatus as defined in claim 12 wherein said vessel includes a lower cylindrical section disposed below said frustoconical section having its lower end fixedly secured in spaced relation to the exterior periphery of said feed tube.

17. Apparatus as defined in claim 16 wherein said helical blade rotor means comprises a cylindrical hub member having helical blade means fixed to the exterior periphery thereof, the lower end portion of said cylindrical hub member being rotatably mounted between the interior periphery of said lower cylindrical section and the coextensive exterior periphery of said feed tube.

18. Apparatus as defined in claim 17 wherein the lower end of said cylindrical hub member has bearing means cooperatively engaged therewith, the upper end of said hub member having a plurality of annularly spaced shaft connecting elements extending therefrom, a shaft connected to said shaft connecting elements and extending upwardly through the upper end portion of said vessel in sealing relation therewith.

19. Apparatus as defined in claim 18 wherein said cylindrical hub member has a ring fixed to the exterior periphery thereof below the helical blade means thereon, and a cooperating resilient annular sealing flap carried by said frustoconical vessel section.

20. Apparatus as defined in claim 19 wherein said frustoconical section has a clear liquid purge conduit extending therethrough between said sealing flap and said bearing means.

21. Apparatus as defined in claim 8 wherein said liquid withdrawal means includes an annular manifold within said vessel at a position above said tangential conduit, the inner periphery of said annular manifold being formed by a cylindrical wall which extends downwardly below said manifold in vertical coextensive relation to said tangential conduit.

22. Apparatus as defined in claim 21 wherein said cylindrical wall includes a series of circumferentially spaced openings extending into said annular manifold.

23. Apparatus as defined in claim 22 including a liquid overflow conduit means in the peripheral wall of said vessel above said annular manifold.

24. Apparatus as defined in claim 23 wherein said mechanical means comprises an annular housing section defining said confined path mounted in fixed relation to said peripheral wall with the lower end thereof communicating with the lower end of said peripheral wall and with its axis extending upwardly in angular relation with respect to the axis of the peripheral wall, and helical blade rotor means mounted within said annular housing section for rotational movement about a rotational axis generally concentric to the axis of said annular housing section.

25. Apparatus as defined in claim 24 wherein said annular housing section is cylindrical and has a series of circumferentially spaced anti-rotation bars extending longitudinally along the lower interior periphery thereof.

26. Apparatus as defined in claim 25 including a vertically extending feed pipe communicating at its upper end with the upper end of said annular housing section and extending downwardly therefrom.

27. Apparatus as defined in claim 26 wherein the axis of said annular housing section extends at an angle of approximately 45° with respect to the axis of said peripheral wall.

28. Apparatus as defined in claim 7 wherein said mechanical means comprises an annular housing section defining said confined path mounted in fixed relation to said peripheral wall with the lower end thereof communicating with the lower end of said peripheral wall and with its axis extending upwardly in angular relation with respect to the axis of the peripheral wall, and helical blade rotor means mounted within said annular housing section for rotational movement about a rotational axis generally concentric to the axis of said annular housing section.

29. Apparatus as defined in claim 28 wherein said annular housing section is cylindrical and has a series of circumferentially spaced anti-rotation bars extending lontitudinally along the lower interior periphery thereof.

30. Apparatus as defined in claim 29 including a vertically extending feed pipe communicating at its upper end with the upper end of said annular housing section and extending downwardly therefrom.

31. Apparatus as defined in claim 30 wherein the axis of said annular housing section extends at an angle of approximately 45° with respect to the axis of said peripheral wall.

32. Apparatus as defined in claim 7 wherein said mechanical means comprises an annular housing section defining said confined path mounted within said vessel, said annular housing section having a generally vertically extending axis and helical blade rotor means mounted within said housing section for rotational movement about a rotational axis generally concentric to the axis of said housing section.

33. Apparatus as defined in claim 32 wherein said housing section is cylindrical and has a series of circumferentially spaced anti-rotation bars extending longitudinally along the interior periphery thereof.

34. Apparatus as defined in claim 33 wherein the helical blade rotor means is hollow and a feed tube is mounted therewithin in fixed relation to said vessel, the upper end of said feed tube being disposed to receive the solid particles issuing from the upper end of said helical blade rotor means, the lower end of said feed tube extending exteriorly of said vessel to said pressurized container.

35. Apparatus as defined in claim 34 wherein said vessel includes a lower cylindrical section having its lower end fixedly secured in spaced relation to the exterior periphery of said feed tube, said helical blade rotor means comprising a cylindrical hub member having helical blade means fixed to the exterior periphery thereof, the lower end portion of said cylindrical hub member being rotatably mounted between the interior periphery of said lower cylindrical section and the coextensive exterior periphery of said feed tube.

36. Apparatus as defined in claim 35 wherein the lower end of said cylindrical hub member has bearing means cooperatively engaged therewith, the upper end of said hub member having a plurality of annularly spaced shaft connecting elements extending therefrom, a shaft connected to said shaft connecting elements and extending upwardly through the upper end portion of said vessel in sealing relation therewith.

37. Apparatus as defined in claim 35 wherein said cylindrical hub member has a ring fixed to the exterior periphery thereof below the helical blade means thereon, and a cooperation resilient annular sealing flap carried by said frustoconical vessel section.

* * * * *